US007878950B1

(12) United States Patent
Bastian

(10) Patent No.: US 7,878,950 B1
(45) Date of Patent: Feb. 1, 2011

(54) SUPPORT APPARATUS FOR AN EXERCISE MACHINE

(75) Inventor: James Bastian, Fargo, ND (US)

(73) Assignee: Bold Endeavors LLC, Fargo, ND (US)

( * ) Notice: Subject to any disclaimer, the term of this patent is extended or adjusted under 35 U.S.C. 154(b) by 0 days.

(21) Appl. No.: 12/564,216

(22) Filed: Sep. 22, 2009

(51) Int. Cl.
*A63B 22/02* (2006.01)
*A63B 71/00* (2006.01)

(52) U.S. Cl. ..... 482/54; 482/62; 482/139

(58) Field of Classification Search ..... 482/51–54, 482/57–63, 148, 91
See application file for complete search history.

(56) References Cited

U.S. PATENT DOCUMENTS 219,439 A 9/1879 Blend
2,625,202 A * 1/1953 Richardson et al. ..... 482/68
3,707,285 A 12/1972 Martin
4,344,616 A 8/1982 Ogden
4,465,274 A 8/1984 Davenport
4,477,073 A * 10/1984 Koch et al. ..... 482/91
4,591,147 A 5/1986 Smith et al.
4,602,779 A 7/1986 Ogden
4,625,962 A * 12/1986 Street ..... 482/116
4,743,009 A 5/1988 Beale
4,861,021 A 8/1989 Edwards
4,984,119 A * 1/1991 Backlund et al. ..... 360/128
5,000,440 A 3/1991 Lynch
5,104,119 A 4/1992 Lynch
5,110,117 A 5/1992 Fisher et al.
5,158,510 A 10/1992 Lemire
5,171,196 A 12/1992 Lynch
5,207,622 A 5/1993 Wilkinson et al.
5,226,866 A 7/1993 Engel et al.
5,254,064 A 10/1993 Rock
5,282,776 A 2/1994 Dalebout
5,344,372 A 9/1994 Hung
5,372,561 A 12/1994 Lynch
5,492,517 A 2/1996 Bostic et al.
5,501,647 A 3/1996 Snyder
5,595,556 A 1/1997 Dalebout et al.
5,632,708 A 5/1997 Wilkinson et al.
5,662,560 A * 9/1997 Svendsen et al. ..... 482/69
5,704,880 A 1/1998 Amatulle
5,860,894 A 1/1999 Dalebout et al.
5,871,421 A 2/1999 Trulaske et al.
5,885,190 A 3/1999 Reiter
5,951,449 A 9/1999 Oppriecht
6,264,584 B1 7/2001 Bass
6,302,828 B1 * 10/2001 Martin et al. ..... 482/69
6,450,923 B1 9/2002 Vatti (Continued)

*Primary Examiner*—Steve R Crow
(74) *Attorney, Agent, or Firm*—Marsh, Fischmann & Breyfogle LLP

(57) ABSTRACT

A user support apparatus for an exercise machine. The user support apparatus is interconnected to a frame of the exercise machine and includes at least one handhold interconnected to a user support. The user support is generally a fixed length member such as a rope or cable that a user of the exercise machine may grasp for support while exercising. The length of the user support may be adjustable. The position of an anchor point for the user support relative to the user may be adjustable, thus allowing the user support to be anchored generally above the user for overhead support, generally in front of the user for pulling support, or at an intermediate position for a combination of overhead and pulling support.

1 Claim, 8 Drawing Sheets

U.S. PATENT DOCUMENTS

| | | | | |
|---|---|---|---|---|
| 6,520,891 | B1 * | 2/2003 | Stephens, Jr. | 482/54 |
| 6,544,147 | B1 | 4/2003 | Wang et al. | |
| 6,821,233 | B1 | 11/2004 | Colombo et al. | |
| 7,125,369 | B2 | 10/2006 | Endelman | |
| 7,163,492 | B1 * | 1/2007 | Sotiriades | 482/51 |
| 7,354,382 | B1 * | 4/2008 | Warren, II | 482/68 |
| 7,494,450 | B2 * | 2/2009 | Solomon | 482/69 |
| 7,524,272 | B2 * | 4/2009 | Bruck et al. | 482/127 |
| 7,575,537 | B2 * | 8/2009 | Ellis | 482/54 |
| 7,775,949 | B2 * | 8/2010 | Bowser | 482/121 |
| 2002/0086779 | A1 | 7/2002 | Wilkinson | |
| 2003/0125164 | A1 | 7/2003 | Kramer et al. | |
| 2004/0204294 | A2 | 10/2004 | Wilkinson et al. | |
| 2005/0277520 | A1 | 12/2005 | Van Waes | |
| 2006/0128532 | A1 | 6/2006 | Wang | |
| 2006/0258513 | A1 | 11/2006 | Routley et al. | |
| 2007/0069101 | A1 | 3/2007 | Shevin-Sandy | |
| 2007/0123396 | A1 | 5/2007 | Ellis | |
| 2007/0191197 | A1 * | 8/2007 | Vittone et al. | 482/121 |
| 2008/0119337 | A1 * | 5/2008 | Wilkins et al. | 482/130 |
| 2009/0054215 | A1 * | 2/2009 | McBride et al. | 482/129 |
| 2010/0197469 | A1 * | 8/2010 | Wilkins et al. | 482/130 |

* cited by examiner

SUPPORT APPARATUS FOR AN EXERCISE MACHINE

FIELD OF THE INVENTION

The present invention relates generally to exercise machines and more specifically to support apparatuses that provide support for a user exercising on an exercise machine.

BACKGROUND OF THE INVENTION

Exercise treadmills and other similar exercise equipment (e.g., elliptical trainers, stair stepper machines) typically include fixed members that a user of the equipment may grasp for support during exercise. These fixed members may be in the form of handrails or fixed handholds that require a user to assume a particular posture or position in order to utilize the fixed members for support. In the case of treadmills, using the fixed members for support may dictate the user's fore/aft position on the movable endless belt of the treadmill. Optionally, a user may forego use of the fixed members for support and operate the exercise equipment without support.

Exercise treadmills and other similar equipment may include upper body exercise systems. For example, such systems may be in the form of handholds interconnected to resistance elements such as weight stacks or elastic elements to provide resistance to motion of the user's hands during exercise.

SUMMARY OF THE INVENTION

Embodiments of the present invention are directed toward exercise systems with support apparatuses that provide support for users thereof. In particular, the support apparatuses provide handholds for users which may be used to provide stability, support, comfort, and/or exercise variability to enhance the exercising experience. The support apparatuses may be associated with various types of exercise equipment, including for example, aerobic exercise equipment such as treadmills, elliptical trainers, stair stepper machines, and exercise bikes. The handholds may be interconnected to user supports that provide movable interconnections between the handholds and fixed members of the exercise systems. In this regard, users may, for example, exert tension on the user supports for support while exercising.

In one aspect, an exercise system includes an exercise treadmill, a rigid sub-frame, a first handhold, and a first user support. The exercise treadmill includes a frame having a front end and a rear end, a longitudinal axis, and a movable endless belt disposed along the longitudinal axis. The rigid sub-frame is adjustably connected to the frame. The sub-frame includes a first user support anchor point. The first handhold is supportably interconnected to the first user support and anchored to the sub-frame at the first user support anchor point. A length of the first user support between the first handhold and the first user support anchor point is adjustably fixed, in that the length may be adjusted to accommodate the user's preferences, and then the length may be fixed while the user is exercising. The first user support between the first handhold and the first user support anchor point is flaccid.

Furthermore, an orientation of the sub-frame may be adjustable relative to the frame such that the first user support anchor point is positionable in at least first and second positions. The first position may be disposed at a first height above the movable endless belt and at a first distance from the rear end along the longitudinal axis, and the second position may be disposed at a second height above the movable endless belt and at a second distance from the rear end along the longitudinal axis. The first height may be greater than the second height, and the second distance may be greater than the first distance.

In an embodiment, the first handhold may include an elongated bar with first and second ends, and the first user support may be interconnected to the elongated bar at the first and second ends. The first user support may include a spring member. Where the exercise system includes a single user support, the spring member may have a spring constant greater than 3 pounds/inch (e.g., 6 pounds/inch). The spring member may function to absorb shock forces that may be imparted on the first handhold by the user of the exercise system. In an embodiment, an entirety of the length of the first user support between the first handhold and the first user support anchor point may be substantially inelastic.

The exercise system may include a second handhold and a second user support. The second handhold may be supportably interconnected to the second user support, which in turn may be anchored to the sub-frame at a second user support anchor point. A length of the second user support between the second handhold and the second user support anchor point may be adjustably fixed. The second user support between the second handhold and the second user support anchor point may be flaccid. The first and second user support anchor points may be disposed along a common portion of the sub-frame.

In another embodiment, the exercise system may include a second user support, and the first handhold may be supportably interconnected to the second user support. The second user support may be anchored to the sub-frame at a second user support anchor point and may be configured similarly to the first user support. The first and second user support anchor points may be disposed along a common portion of the sub-frame. The first handhold may be in the form of an elongated bar with first and second ends, with the first user support interconnected to the first end, and the second user support interconnected to the second end (e.g., forming a trapeze-like arrangement). The interconnections may be fixed (e.g., the user supports may be in the form of ropes or cables tied to the ends of the elongated bar) or non-fixed (e.g., the elongated bar may be in the form of a tube and the first and second user supports may each be a portion of a single rope or cable running through the tube). Additionally, the handhold may optionally include first and second vertical bars. The first vertical bar may be interconnected to the first end of the elongated bar via a first universal joint, and the second vertical bar may be interconnected to the second end of the elongated bar via a second universal joint. In such a configuration, the first user support may be interconnected to the first vertical bar, and the second user support may be interconnected to the second vertical bar.

The entire lengths of the first and second user supports between the first handhold and the first and second user support anchor points, respectively, may be substantially inelastic.

With respect to the first position of the user support anchor point, the first height of the first user support anchor point may be greater than 72 inches and may be selected such that it is positioned generally at a level higher than a height of a typical user. With respect to the second position of the user support anchor point relative to the first position, the first height may be at least 10 inches greater than the second height, and the second distance from the rear end of the frame may be at least 18 inches greater than the first distance from the rear end of the frame. In this regard, the second position may be generally disposed such that it is in front of a user of the exercise system. The sub-frame may be adjustable relative to the frame such that the first user support anchor point may be positionable in a plurality of positions (e.g., in discrete positions or in a continuum of positions) between the first and second positions.

The sub-frame may be interconnected to the frame along a pivot axis, and the pivot axis may be disposed above the movable endless belt perpendicular to the longitudinal axis. The sub-frame may be in the form of an inverted U with the pivot axis passing through both ends of the inverted U. The sub-frame may be adjustable between a first position 30 degrees above a horizontal position and a second position pivoted 70 degrees relative to the first position and above the horizontal position.

The first and second user supports may include spring members. The spring members may each have a spring constant greater than 1.5 pounds/inch, such as 3 pounds/inch.

In another aspect, an exercise system is provided that includes an aerobic exercise machine, a rigid sub-frame, a handhold, and a user support. The aerobic exercise machine includes a frame having a front end and a rear end, and a longitudinal axis extending from the front end to the rear end. The rigid sub-frame is connected to the frame and includes a user support anchor point. The handhold is supportably interconnected to the user support. The user support is anchored to the sub-frame at the user support anchor point. The user support between the handhold and the user support anchor point may hang from the user support anchor point. The user support may be flaccid, substantially inelastic and a length thereof may be adjustably fixed.

The sub-frame may be pivotally adjustable relative to the frame such that the user support anchor point may be positionable in at least first and second positions. The first position may be disposed at a first height and at a first distance from the rear end along the longitudinal axis, and the second position may be disposed at a second height and at a second distance from the rear end along the longitudinal axis. The first height may be greater than the second height, and the second distance may be greater than the first distance.

The aerobic exercise machine may be a treadmill that includes a console and a movable endless belt disposed along the longitudinal axis. Along the longitudinal axis, the user support anchor point may be disposed on an opposite side of the console from a majority of the movable endless belt.

In another aspect, a handhold system for attachment to a treadmill is provided that includes a rigid frame, a user support anchor point disposed on the rigid frame, a mounting member, a handhold, and a support member anchored to the user support anchor point. The rigid frame is interconnected to the mounting member and the handhold is supportably interconnected to the user support. The mounting member is attachable to a handrail of a treadmill. The user support between the handhold and the anchor point is flaccid.

In an embodiment, the rigid frame may be adjustable relative to the mounting member such that the rigid frame may be operable to pivot at least 60 degrees relative to the mounting block. An entirety of the user support between the handhold and the user support anchor point may be substantially inelastic.

In another aspect, a method of exercising is provided that includes exercising, by a user, on a moving endless belt of an exercise treadmill, and grasping, by the user, a handhold for support while performing the exercising step. The handhold is interconnected to a flaccid and substantially inelastic user support, which is interconnected to a rigid sub-frame, which is, in turn, interconnected to a frame of the exercise treadmill.

An entirety of the rigid sub-frame may be below a height of the user during performance of the exercising and grasping steps. The method may include adjusting an orientation of the rigid sub-frame relative to the frame such that a portion of the rigid sub-frame may be overhead (e.g., at a height greater than that of the user) of the user when the user is atop the moving endless belt.

Additional aspects and advantages of the present invention will become apparent to one skilled in the art upon consideration of the further description that follows. It should be understood that the detailed description and specific examples are intended for purposes of illustration only and are not intended to limit the scope of the invention. Furthermore, any of the above arrangements, features and/or embodiments may be combined with any of the above aspects where appropriate.

BRIEF DESCRIPTION OF THE DRAWINGS

For a more complete understanding of the present invention and further advantages thereof, the following Detailed Description of the Invention is provided along with the following drawings.

DETAILED DESCRIPTION OF THE INVENTION

In the following description, embodiments of the present invention are set forth in the context of exercise machines with support apparatuses that provide support for users thereof. In particular, the support apparatuses may provide handholds for users which may be used to provide stability, support, comfort, and exercise variability to enhance the exercising experience. The support apparatuses may be associated with various types of exercise equipment, including for example, aerobic exercise equipment such as treadmills, elliptical trainers, stair stepper machines, and exercise bikes.

Figure 1:
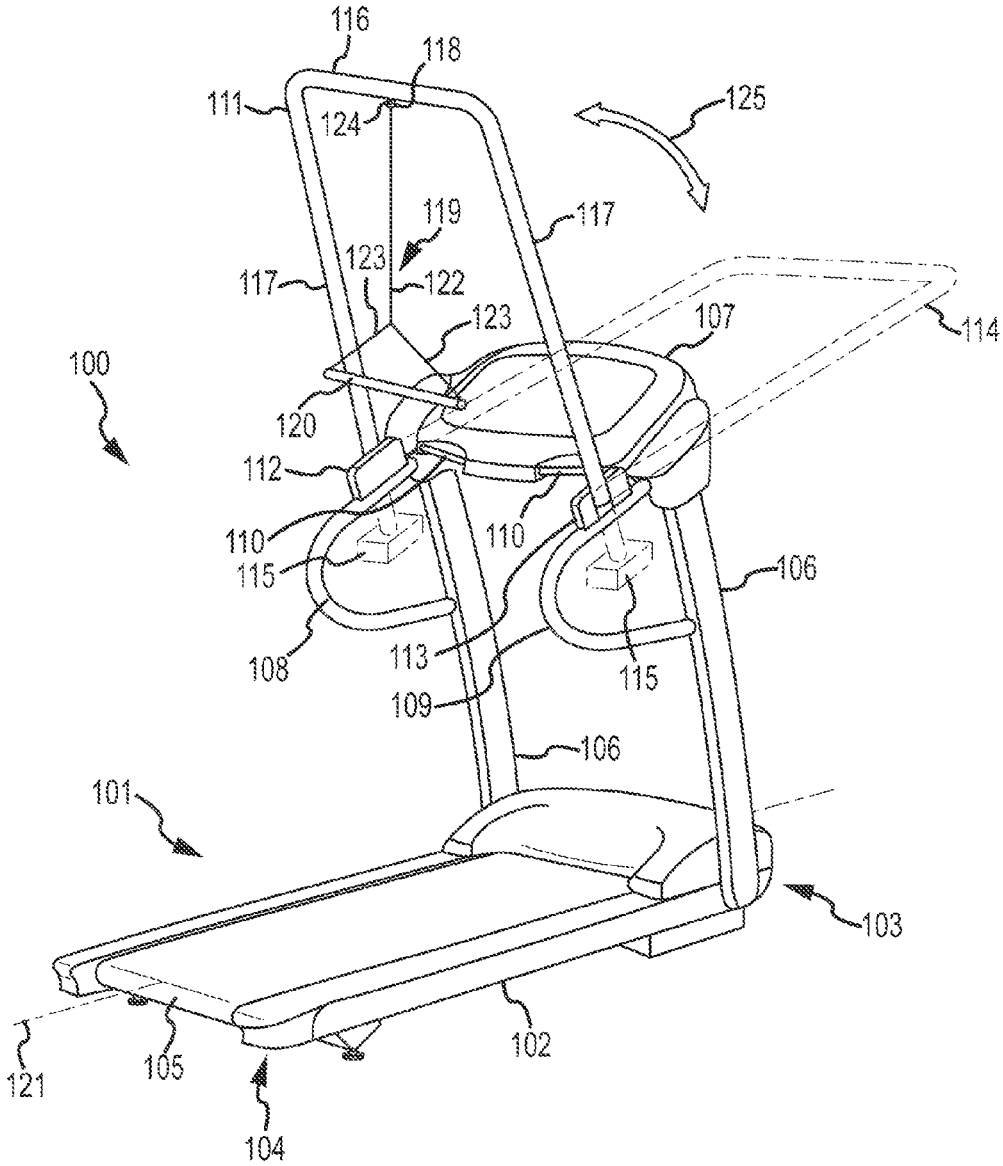
FIG. 1 is an illustration of an exercise system that includes a user support.

FIG. 1 illustrates an exercise system 100 that includes an exercise treadmill 101. The treadmill 101 includes a frame 102. The frame 102 includes a frame front end 103 and a frame rear end 104. The exercise treadmill 101 further includes a movable endless belt 105 disposed along a longitudinal axis 121 of the exercise treadmill 101. The longitudinal axis 121 is oriented horizontally (e.g., parallel to a floor on which the treadmill 101 is disposed). The movable endless belt 105 is disposed "along the longitudinal axis 121" in that when the movable endless belt 105 is in a horizontal position, the movable endless belt 105 is disposed parallel to the longitudinal axis 121. Where the angle of the movable endless belt 105 is adjustable, the positions in which the movable endless belt 105 may be disposed (e.g., inclined 10 degrees) are also considered to be oriented "along the longitudinal axis 121." A top surface of the movable endless belt 105 is generally moved toward the rear end 104 to provide a moving surface for a user of the exercise system 100 to walk, jog or run upon. In this regard, the user generally is positioned facing the frame front end 103 (e.g., as shown in FIGS.

8A-8C). Typically, a motor (not shown) drives the movable endless belt 105 and is generally located at frame front end 103.

The exercise treadmill 101 further includes a vertical support 106 that supports a console 107, along with a left side fixed support 108 and a right side fixed support 109. The console 107 may include a pair of front handholds 110 that are disposed in front of the user exercising on the exercise treadmill 101. The console 107 may include displays, buttons, or other inputs and outputs that may be used to provide feedback to the user and control various exercise treadmill 101 functions.

The exercise treadmill 101 further includes a sub-frame 111. The sub-frame 111 may be provided by the manufacturer of the exercise treadmill 101, or the sub-frame 111 and associated components and hardware (e.g., nuts, bolts, clamps) may be sold separately (either by the manufacturer of the exercise treadmill 101 or by another entity) for installation onto the exercise treadmill 101. The sub-frame 111 may be substantially rigid in that any flexure of the sub-frame 111 may be insignificant and/or may go unnoticed by the user. In an alternate embodiment, the sub-frame 111 may be a standalone structure capable of being positioned proximate to the exercise treadmill 101. The sub-frame 111 illustrated in FIG. 1 is in the form of an inverted U and is interconnected to the exercise treadmill 101 via a left mounting block 112 and a right mounting block 113. The left and right mounting blocks 112, 113 may be interconnected to the left and the right side fixed supports 108, 109, respectively, by any appropriate means including, for example, clamps, tie wraps, or welds. In this regard, the left and right mounting blocks 112, 113 may be specifically adapted to interconnect to the left and a right side fixed supports 108, 109. In turn, the sub-frame 111 is interconnected to the left and right mounting blocks 112, 113.

As illustrated in FIG. 1, the position of the sub-frame 111 relative to the exercise treadmill 101 may be adjustable. More particularly, the orientation of the sub-frame 111 relative to the exercise treadmill 101 may be adjustable (e.g. the sub-frame 111 may be operable to pivot relative to the exercise treadmill 101). In this regard, the interconnection between the sub-frame 111 and the left and right mounting blocks 112, 113 may be adjustable. The sub-frame 111 may be adjustable from a generally upright position (as illustrated in FIG. 1) to a generally forward (of a user exercising on the exercise treadmill 101) position 114. Furthermore, the sub-frame 111 may be positioned in a plurality of positions between the generally upright position and the generally forward position 114. Repositioning may be achieved by pivoting the sub-frame 111 relative its interconnection to the left and right mounting blocks 112, 113 along the direction arrow 125.

The pivoting motion of the sub-frame 111 relative to the left and right mounting blocks 112, 113 may be achieved in any appropriate manner. For example, the sub-frame 111 may include holes that accept and rotate about pins (not illustrated) extending from the left and right mounting blocks 112, 113, and the sub-frame 111 may be pivotally mounted to those pins. In such an embodiment, a user may adjust the sub-frame 111 to achieve a desirable position and then fix the sub-frame 111 relative to the left and right mounting blocks 112, 113. The fixing of the sub-frame 111 relative to the left and right mounting blocks 112, 113 may be achieved in any appropriate manner, such as for example, inserting pins through corresponding holes in the sub-frame 111 and the mounting blocks 112, 113, where the corresponding holes are offset from the pivot point of the sub-frame 111. Such a configuration may yield a discrete number of available positions for the sub-frame 111. In another example, clamps may be used to secure the position of the sub-frame 111 relative to the mounting blocks 112, 113. In such a configuration, the position of the sub-frame 111 may be continuously adjustable relative to the mounting blocks 112, 113.

Optionally, counterweights 115 may be interconnected to the sub-frame 111. The counterweights 115 may be positioned to provide a counterforce to the portion of the sub-frame 111 disposed above the mounting blocks 112, 113. In this regard, the counterweights 115 may reduce the effort necessary to pivot the sub-frame 111 when adjusting the position of the sub-frame 111.

The sub-frame 111 includes a crossbar 116 and two crossbar supports 117. The length of the crossbar supports 117 between the left and right mounting blocks 112, 113 and the crossbar 116 may be adjustable. For example, the crossbar supports 117 may each include an inner portion and an outer portion, where the inner portion has an outside diameter that may fit within an inside diameter of the outer portion. In such an example, the inner portions may include spring-loaded pins with corresponding holes on the outer portions, and by telescopically adjusting the inner portion relative to the outer portion, the lengths of the crossbar supports 117 may be adjusted. In this regard, the distance of the crossbar 116 from a user exercising on the exercise system 100 may be adjusted. Such adjustment may accommodate users of varying heights and/or accommodate positioning of the exercise system 100 (e.g., the lengths of the crossbar supports 117 may be shortened to lower the crossbar 116 to accommodate a relatively low ceiling).

The sub-frame 111 includes an anchor point 118. A user support 119 may be interconnected to the crossbar 116 at the anchor point 118. A handhold 120 may be interconnected to the user support 119. A tensile load placed on the user support 119 (e.g., from the weight of the user support 119, from a user of the exercise system 100) may result in an opposite load being supported by the anchor point 118. For example, the anchor point 118 may be in the form of an eyelet 124 bolted to the crossbar 116, and the user support 119 may be in the form of a rope tied to the eyelet 124.

In another example, the anchor point 118 may be in the form of a pulley interconnected to the crossbar 116, and the user support 119 may be in the form of a cable partially wrapped around the pulley. A first end of such a cable may be interconnected to the handhold 120 and a second end of the cable may be remotely anchored with an intermediate portion of the cable being partially wrapped around the pulley. In such an embodiment, the anchor point 118 supports a tensile load imparted on the user support 119 by a user of the exercise system 100.

Hereinafter, the rotational position of the sub-frame 111 will be described in degrees of counterclockwise rotation from a position parallel to the longitudinal axis 121 with the crossbar 116 forward of the left and right mounting blocks 112, 113. For example, the sub-frame 111 of FIG. 1 is positioned at about 100 degrees.

The pivotal adjustability of the sub-frame 111 discussed above may be used to adjust the position of the anchor point 118 relative to a user exercising on the exercise system 100. In this regard, the position of the sub-frame 111 illustrated in FIG. 1 may generally position the anchor point 118 above the head of a user exercising on the exercise system 100. Along the same lines, the forward position 114 may generally position the anchor point 118 in front of a user of the exercise system 100. To position the anchor point 118 overhead of a user, the sub-frame 111 may be positioned such that it is, for example, at 80 to 100 degrees of rotation relative to the longitudinal axis 121. Such positioning may place the anchor point 118 at least 72 inches above the movable endless belt 105. For example, the sub-frame 111 may be configured such that when it is at 90 degrees relative to the longitudinal axis 121, the anchor point 118 is disposed at a height of 84 inches above the movable endless belt 105, thus accommodating users who are well over 6 feet tall. When in the forward position at 114, the sub-frame 111 may be disposed at least 20 degrees rotation relative to the longitudinal axis 121 (e.g., at 30 degrees). The sub-frame 111 may be operable to rotate through at least 60 degrees (e.g., 70 degrees) of rotation relative to the longitudinal axis 121. In such a forward position, the anchor point 118 may be positioned in front of a user of the exercise machine 100. For example, in the forward position 114, the anchor point 118 may be positioned generally at or below eye level of an average-sized user exercising on the exercise machine 100. In this regard, the sub-frame 111 may be pivoted from 90 degrees from the longitudinal axis 121 to an angle less than 90 degrees (e.g., 20 degrees) from the longitudinal axis and the anchor point 118 may be lowered relative to the movable endless belt 105 (by at least 10 inches; for example by 18 inches) and moved forward relative to frame 102 (e.g., by at least 18 inches; for example by 30 inches).

Where the sub-frame 111 is attached to aerobic exercise equipment other than a treadmill, the sub-frame 111 may be may be configured such that when it is positioned vertically (e.g., at 90 degrees relative to a longitudinal axis of the aerobic exercise equipment), the anchor point 118 is overhead of a typical user of the aerobic exercise equipment.

As illustrated in FIG. 1, the user support 119 may be in the form of a flexible, flaccid member such as a rope, cable or monofilament line. The user support 119 may be substantially inelastic in that a user exercising on the exercise system 100 may not feel any give in the user support 119 when the user subjects the user support 119 to a tensile load (e.g., by exerting down force on the handhold 120). As such, the substantially inelastic user support 119 does not substantially elongate in reaction to tensile load, such as would occur with an elastic member. Consequently, the substantially inelastic user support 119 provides a firmer support than would be achieved with an elastic member.

The handhold 120 is interconnected to the user support 119 such that the handhold 120 is positioned such that a user exercising on the exercise machine 100 may grasp the handle 120 with one or both hands. In this regard, the handhold 120 may be wide enough such that a user may grasp the handhold 120 so that the user's hands are spaced comfortably apart during exercise. For example, the handhold 120 may be 10 to 18 inches in length such that a user may grasp the handhold 120 with the user's hands spaced apart roughly slightly less than the typical user's shoulder-to-shoulder width.

The user support 119 may be interconnected to both ends of the handhold 120 and to the anchor point 118. In this regard, the user support 119 may be in the form of an inverted Y, with a first portion 122 (the base of the Y) interconnected to the anchor point 118 on one end and to the two angled portions 123 of the Y on the other end. The two angled portions 123 may each be connected to the first portion 122 on one end, and to opposing ends of the handhold 120 on the other end. In an alternate embodiment (not shown), the user support 119 may interconnect to the handhold 120 at a central point along the handhold 120 such that the user support 119 and handhold 120 together form an upside down T-shaped structure.

As noted earlier, the sub-frame 111 and associated components may be provided with the treadmill 103, or they may be sold separately for installation onto the exercise treadmill 101. In the latter case, the associated components may include the mounting blocks 112, 113, counterweights 115, eyelet(s) 124, user support(s) 119, handhold(s) 120 and appropriate hardware (e.g., nuts, bolts, clamps).

Several variations to the configuration of the user support 119, the handhold 120, and how the handhold anchors to the crossbar 116 will now be described with reference to FIGS. 2 through 7. Although certain figures illustrate certain combinations of features of the user support 119, handhold 120 and crossbar 116, it is to be understood that various features illustrated in one of the figures may be used with any other appropriate features illustrated in other figures.

Figure 2:
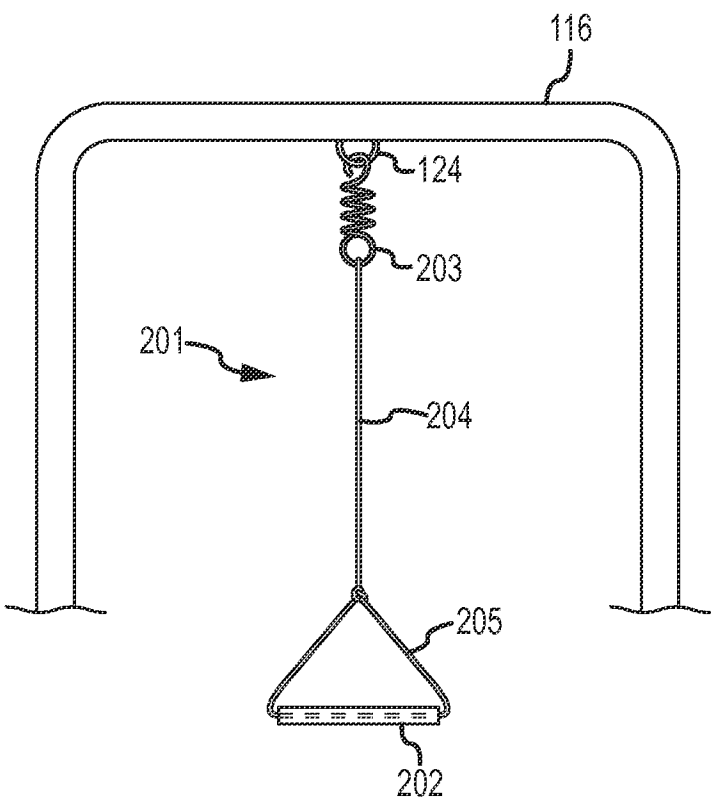

FIG. 2 illustrates an alternate configuration of a user support 201 and handhold 202. The configuration includes a spring 203 disposed between a flaccid upper portion 204 and the eyelet 124. The spring 203 may be configured to provide a cushioning effect with respect to shock forces that may be created by a user exercising on the exercise machine 100 imparted on the handhold 202. In this regard, the spring 203 may not be conducive to the user performing upper body exercises by alternately extending and retracting the spring 203. Accordingly, the spring 203 may have a spring rate of greater than 3 pounds/inch. The spring 203 may also include a member configured to limit the extension of the spring 203 to a predetermined distance. For example, an inelastic cable may be disposed within the coil of the spring 203 (where spring 203 is a coil spring) and attached to both ends of the spring 203. In such a configuration, when the spring extends to the length of the inelastic cable, an increase of tensile force on the spring 203 will be borne by the inelastic cable and no more extension of the spring 203 will take place, thus limiting the extension of the spring 203.

Additionally, the handhold 202 of the configuration of FIG. 2 is not fixedly interconnected to the user support 201. The handhold 202 is configured with a through hole through which a flaccid lower portion 205 of the user support 201 is disposed. As such, the handhold 202 may slide along the lower portion 205. Accordingly, a user holding on to the handhold 202 while exercising on the exercise machine 100 may be able to hold the handhold 202 at an angle relative to the crossbar 116 while maintaining tension in both portions of the lower portion 205 of the user support 201.

In a variation of the user support 201 of FIG. 2, the spring 203 may not be present and the flaccid upper and lower portions 204, 205 together may have elasticity such that the entire user support 201 has spring constant equivalent to that of the user support 201 with the spring 203. In such an embodiment, the entire user support 201 may have a total spring rate of greater than 3 pounds/inch.

Figure 3:
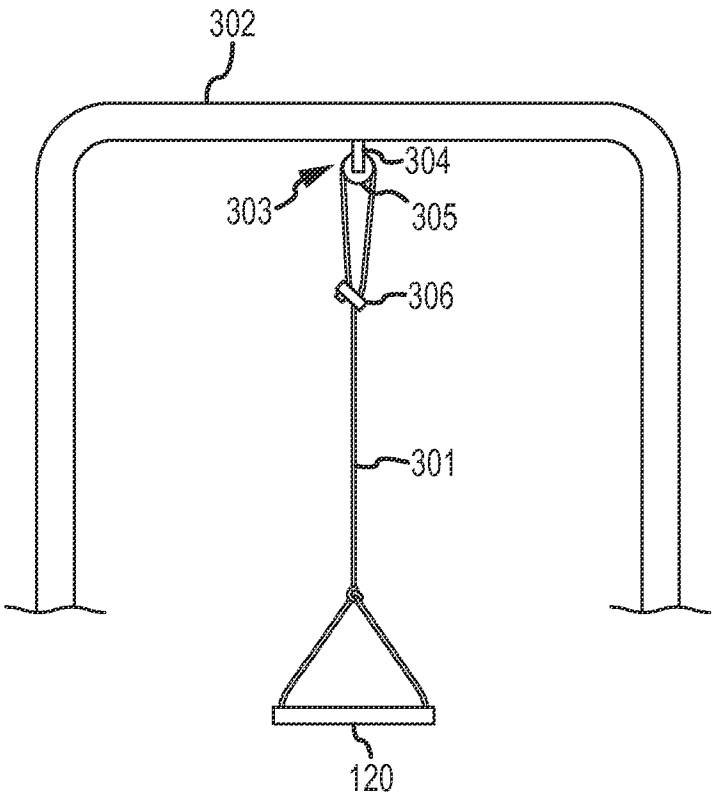
FIGS. 2 through 7 illustrate alternate configurations of user supports for the exercise system of FIG. 1.

FIG. 3 illustrates an alternate configuration of a user support 301 and handhold 120. The user support 301 is interconnected to a crossbar 302 and the handhold 120. The crossbar 302 is similar to crossbar 116 of FIG. 1 with the eyelet 124 replaced with a pulley assembly 303. The pulley assembly 303 includes a mounting bracket 304 and a pulley 305. The mounting bracket 304 may be operable to rotate relative to the crossbar 302 or it may be fixed relative to the crossbar 302. A portion of the user support 301 may be wound around the pulley 305. The user support 301 may include an adjustment member 306. The adjustment member 306 may be used to adjust the length of the user support 301. In this regard, the distance between the crossbar 302 and the handhold 120 when the user support 301 is under a tensile load may be established. This also adjusts the height of the handhold 120 relative to a user of the exercise system 100 when the crossbar 302 is positioned in an overhead position (e.g., at 90 degrees).

Figure 9:
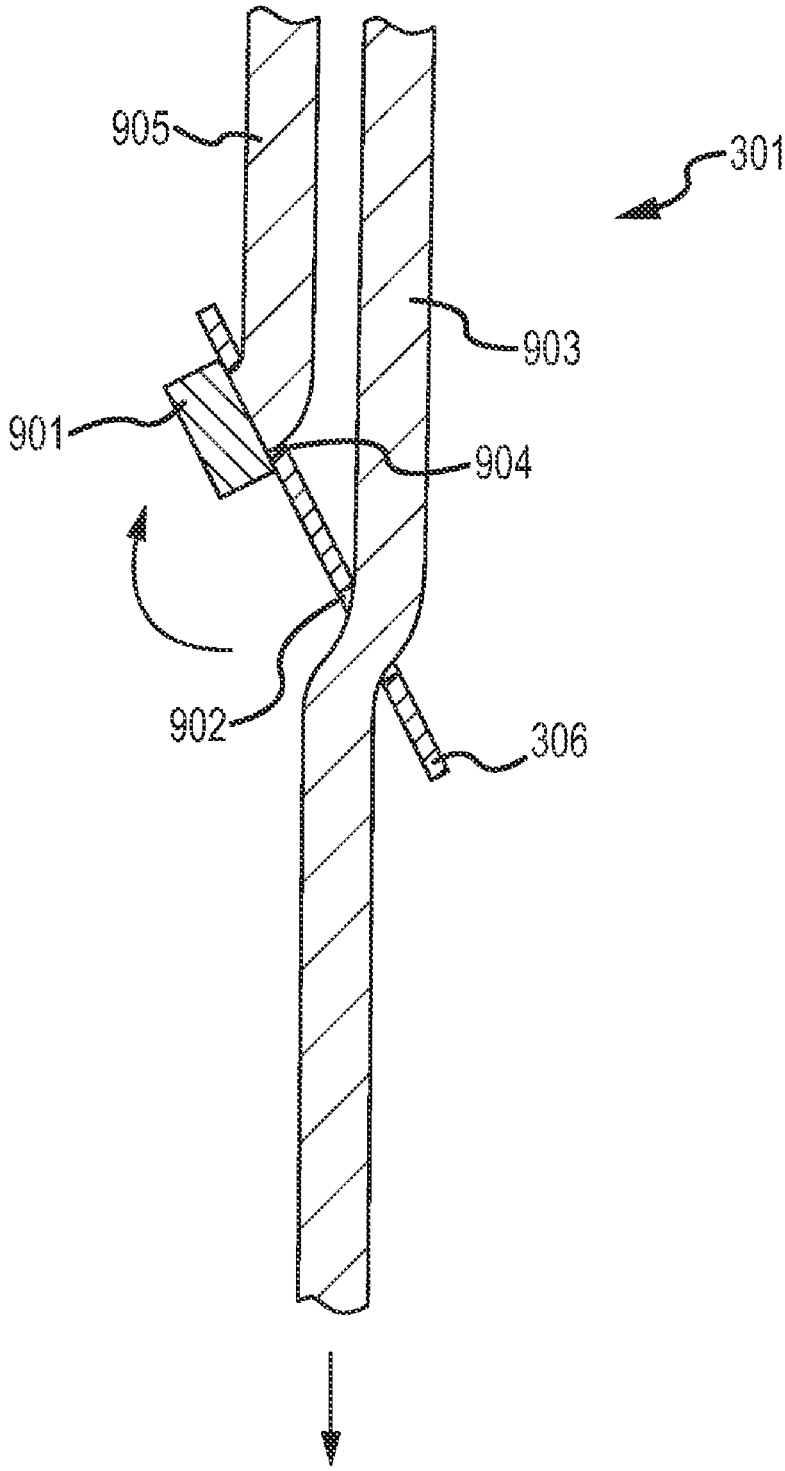
FIG. 9 illustrates an adjustment member for adjusting the length of a user support.

Turning briefly to FIG. 9, the operation of the adjustment member 306 will be described. One end of the user support 301 is attached to the crossbar 120 (not shown in FIG. 9) below the portion of the user support 301 illustrated in FIG. 9. The other end of the user support 301 winds around the pulley 305 (not shown in FIG. 9) above the portion of the user support 301 illustrated in FIG. 9, and is secured to the user support 301 via the adjustment member 306. The end of the user support 301 adjacent the adjustment member 306 includes a stopper 901 to prevent the user support 301 from sliding completely through the adjustment member 306.

The adjustment member 306 generally includes a first opening 902 for receiving a first portion 903 of the user support 301, and a second opening 904 for receiving a second portion 905 of the user support 301. The first portion 903 extends from one side of the pulley 305 and the second portion 905 extends from an opposite side of the pulley 305. The adjustment member 306 is generally comprised of a thin plate-like structure. To adjust the height of the handhold 120, the adjustment member 306 is pivoted perpendicular with the user support 301 so that the first portion 903 and the second portion 905 of the user support 301 align with a respective opening.

The adjustment member 306 may then be moved vertically along the first portion 903 of the user support 301 thus effectively raising or lowering the handhold 120. When the handhold 120 is at a desired height, the adjustment member 306 and handhold 120 are released, thus effectively forcing the adjustment member 306 to pivot via the weight of the handhold 120 upon the first portion 903 thus kinking the user support 301 and holding the handhold 120 at a given vertical height. As more weight is placed upon the handhold 120 the adjustment member 306 further kinks the user support 301.

Accordingly, where a user support includes an adjustment member such as adjustment member 306, the length of such a user support may be "adjustably fixed." "Adjustably fixed" refers to a configuration where the length of the user support between a handhold and a crossbar may be fixed during exercise, yet that length may be adjusted by manipulating an adjustment member such as adjustment member 306. For example, the length may be fixed in that a user may place tensile loads on the user support during exercise without causing any significant lengthening (e.g., beyond extension of a spring for a cushioning effect such as discussed with reference to spring 203) of the distance between the handhold and the crossbar.

Figure 4:
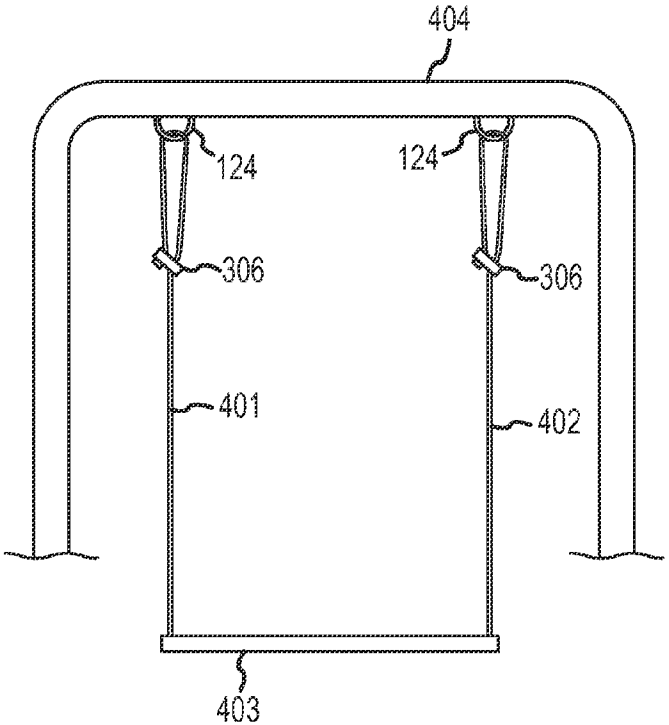

FIG. 4 illustrates an alternate configuration of the exercise system 100 that includes a first user support 401 and a second user support 402. The first and second user supports 401, 402 are attached to a handhold 403 to support the handhold 403. Each of the first and second user supports 401, 402 are supported by eyelets 124 attached to a crossbar 404. The lengths of the first and second user supports 401, 402 are adjustable via adjustment members 306.

In a variation of the illustrated embodiment of FIG. 4, the first user support 401 and the second user support 402 may be constructed from a single length of material (e.g., rope, cable). In such a variation, the handhold 403 may be in the form of a hollow tube through which the single length of material may be run. In such an embodiment, the handhold 403 may be operable to slide along the single life of material allowing the handhold 403 to be at an angle relative to the crossbar 404 while maintaining tension in the entirety of the single length of material.

Figure 5A:
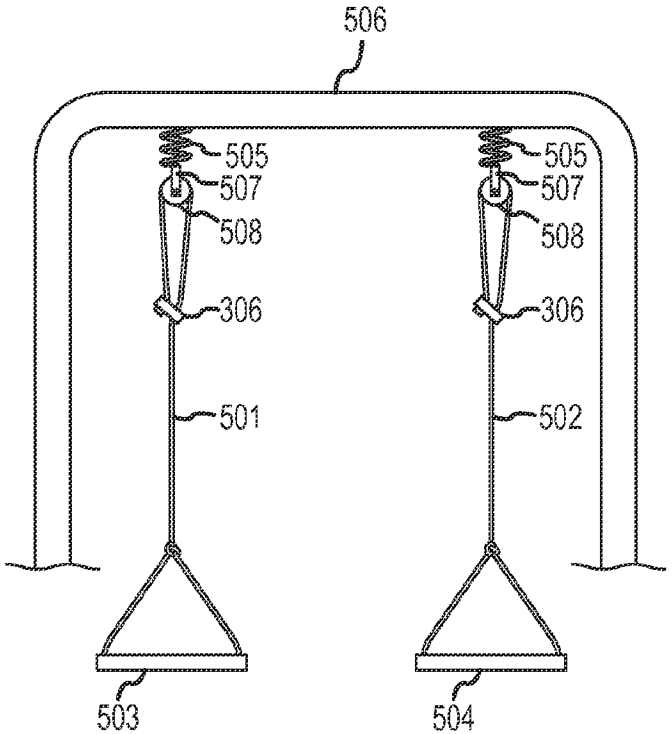

FIG. 5A illustrates another alternate configuration of the exercise system 100 that includes a first user support 501 and a second user support 502 where the first and second user supports 501, 502 are not interconnected to each other by a single handhold. The configuration of FIG. 5A includes a first handhold 503 interconnected to the first user support 501 and a second handhold 504 interconnected to the second user support 502. The lengths of the first and second user supports 501, 502 are independently adjustable via adjustment members 306. The first and second user supports 501, 502 are interconnected to a crossbar 506 by springs 505, spring-to-pulley members 507, and pulleys 505 (thus combining the spring configuration of FIG. 2 and the pulley configuration of FIG. 3).

The first and second user supports 501, 502 may each be configured similarly to the user support 301 of FIG. 3 in that the first and second user supports 501, 502 may be generally configured in a inverted Y, with the angled portions of the inverted Y interconnected to their respective first and second handholds 503, 504. The first and second handholds 503, 504 may be sized to accept a single hand of a user of the exercise system 100 and therefore may be smaller than the handled 120 of FIG. 3. For example, the first and second handholds 503, 504 may each be four to seven inches in length.

In a variation of the embodiment illustrated in FIG. 5A, the first and second handholds 503, 504 may each be in the form of a hollow tube through which the first and second user supports 501, 502 may be respectively run (similar to the configuration of FIG. 2). In such an embodiment, the first and second handholds 503, 504 may be operable to slide along their respective user supports 501, 502 allowing the first and second handholds 503, 504 be at an angle relative to the crossbar 506 while maintaining tension in the entirety (e.g., in both angled portions of the Y) of the first and second user supports 501, 502.

Figure 5B:
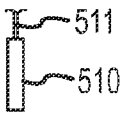

FIG. 5B illustrates an alternative configuration of a handhold 510 and a user support 511 that may be used in the configuration illustrated in FIG. 5A (substituting the handhold 510 for the first and second handholds 503, 504). The handhold 510 is in the form of a single elongated member interconnected to a user support 511 at a single interconnection point.

Figure 6:
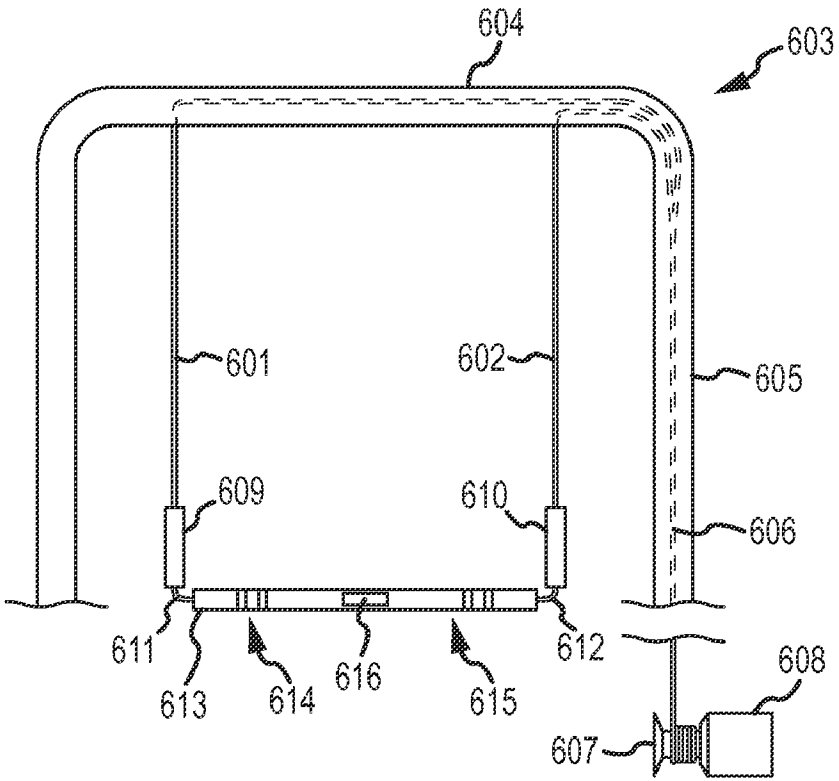

FIG. 6 illustrates another alternate embodiment of the exercise system 100 that includes a first user support 601 and a second user support 602 interconnected to a sub-frame 603 at a crossbar 604. In the embodiment of FIG. 6, portions of the first and second user supports 601, 602 may extend into the crossbar 604 and down along a vertical support 605. Within in the sub-frame 603, the first and second user support 601, 602 may be interconnected to a single elongated member 606. The elongated member 606 may be constructed similarly to the first and second user supports 601, 602. For example, the first and second user supports 601, 602 and the elongated member 606 may each be constructed from rope or cable. In turn, the elongated member 606 may be wound around a spool 607 interconnected to a motor 608. The motor 608 may be mounted in any appropriate position within the exercise system 100. By activating the motor 608 to rotate the spool 607, the elongated member 606 may be further wound or unwound from the spool 607, thus making the portions of the first and second user supports 601, 602 outside of the sub-frame 603 shorter or longer, respectively. In this manner, the lengths of the first and second user supports 601, 602 outside of the sub-frame 603 may be adjusted. Such adjustment may be initiated by a user of the exercise system 100 activating a user control (e.g., a button or a toggle switch). The user control may be located on the console 107 of exercise system 100 or in any other appropriate location.

The first and second user supports 601, 602 may be interconnected to first and second vertical handholds 609, 610, respectively. The first and second vertical handholds 609, 610 may be configured similarly to the handhold 510 of FIG. 5B with the addition that each vertical handhold 609, 610 may be interconnected to a universal joint 611, 612, respectively, that is in turn interconnected to a horizontal handhold 613. Such a configuration presents a user of the exercise system 100 with the ability to use (e.g., for support during exercise) the vertical handholds 609, 610, the horizontal handhold 613, or a combination of one of the vertical handholds 609, 610 and the horizontal handhold 613.

In a variation, the vertical handholds 609, 610 may be hollow, and the respective first and second user supports 601, 602 may run through the vertical handholds 609, 610 and attach directly to the horizontal handhold 613. At least a portion of each of the vertical handholds 609, 610 may be operable to freely rotate about an axis along its respective length.

The horizontal handhold 613 may include a first pair of contacts 614 and a second pair of contacts 615. The pairs of contacts 614, 615 may be disposed along the horizontal handhold 613 such that they are generally in the area where the user of the exercise system would normally grasp when using the horizontal handhold 613 during exercise. By grasping the horizontal handhold 613 such that the user contacts at least a portion of the pairs of contacts 614, 615, electronics disposed within the horizontal handhold 613 may be operable to determine the heart rate of the user of the exercise system 100. The heart rate of the user may then be displayed in a display 616 located along the horizontal handhold 613. Additionally, or alternatively to the display on the horizontal handhold 613, a wireless transmitter may be disposed within the horizontal handhold 613 and may wirelessly transmit data containing the heart rate information (e.g., for display on the console 107).

Figure 7:
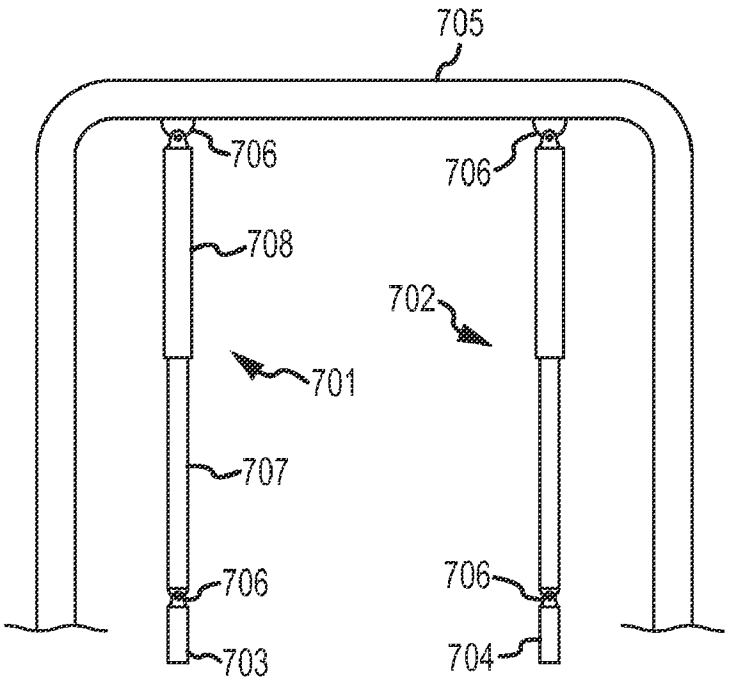

FIG. 7 illustrates another alternate embodiment of the exercise system 100 that includes a first user support 701 and a second user support 702 interconnected to a crossbar 705. In this embodiment, the first and second user supports 701,702 are substantially rigid elongated members. A first handhold 703 is interconnected to the first user support 701, and a second handhold 704 is interconnected to the second user support 702. The handholds 703,704 may be interconnected to the first and second user supports 701,702 by universal joints 706. The first and second user supports 701,702 may be interconnected to the crossbar 705 via universal joints 706. The universal joints 706 may be in any appropriate form, including, for example, forms with rigid members (e.g., interconnected to each other through rotatable and/or pivotable interconnections) and forms with flexible members (e.g., short portions of rope or cable).

The length of the first user support 701 may be adjustable. In this regard, the first user support 701 may include an inner member 707 and an outer member 708. The inner member 707 may be partially disposed within a portion of the outer member 708. The length of the inner member 707 disposed within the outer member 708 may be adjustable such that the overall length of the first user support 701 is adjustable. In this manner, the distance between the crossbar 705 and the first and second handholds 703, 704 may be adjusted. For example, the inner member 707 may include a spring-loaded pin with corresponding holes on the outer member 708, and by telescopically adjusting the inner member 707 relative to the outer member 708, the length of the first user support 701 may be adjusted. Any other appropriate method of adjusting the length of a two piece telescoping member may be used in the first user support 701. The second user support 702 may be configured similarly to the first user support 701.

The handholds, user supports and crossbars and associated members described with respect to the embodiments illustrated in FIGS. 1 through 7, may be used in additional embodiments in any appropriate combination. For example, the spring and pulley arrangement of FIG. 5A may be used in a single line embodiment such as illustrated in FIG. 1. In another example, the pulse monitoring feature illustrated in FIG. 6 may be used in any other of embodiment. As stated earlier, although certain figures illustrate certain combinations of features of the handholds, user supports and crossbars, it is to be understood that these are exemplary and that other combinations of these features are also contemplated.

Figure 8A:
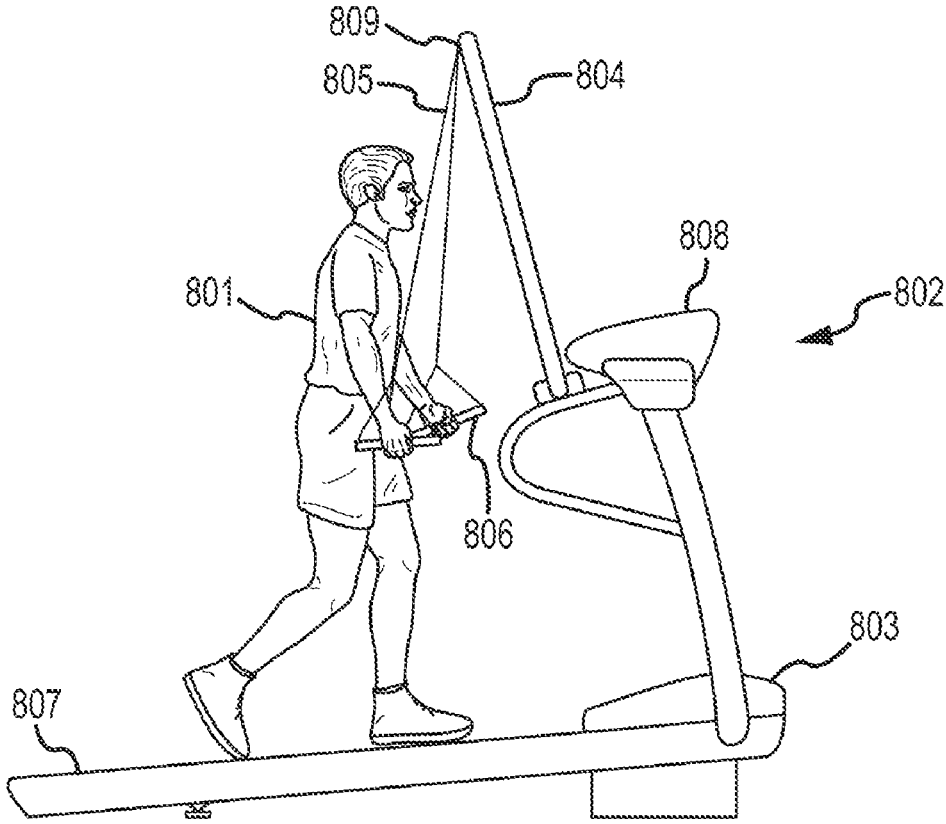
FIGS. 8A and 8B illustrate a user exercising on another embodiment of an exercise system.
Figure 8B:
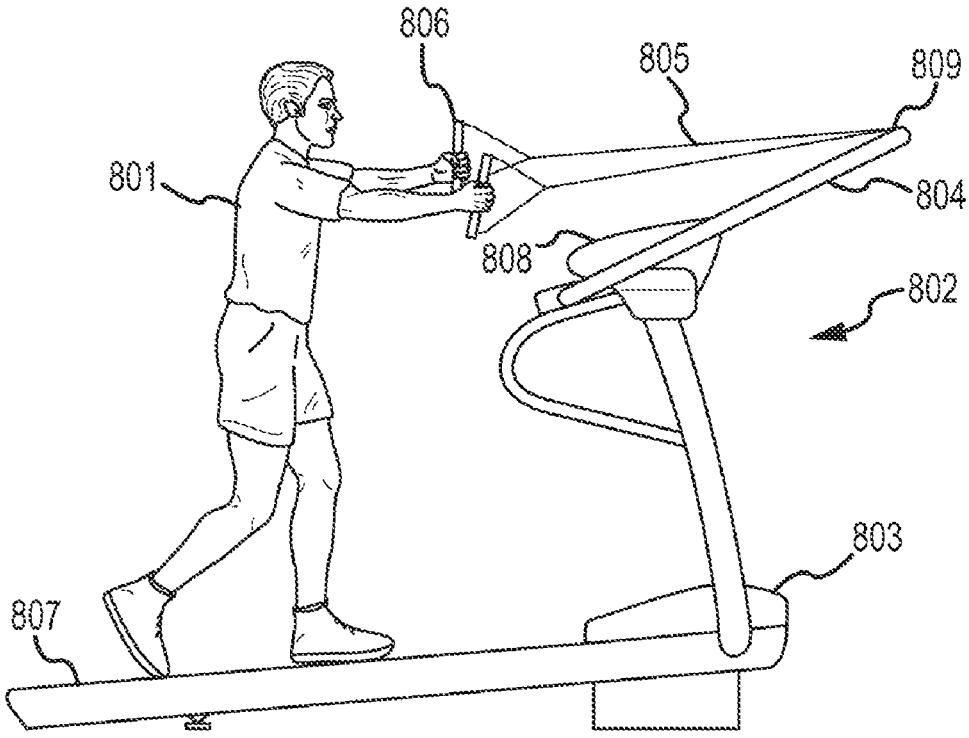

FIGS. 8A and 8B illustrate a user 801 exercising on an exercise system 802 that includes a treadmill 803 and a sub-frame 804 interconnected to the treadmill 803. The sub-frame 804 supports a pair of user supports 805 which in turn are interconnected to a pair of handholds 806. Use of the exercise system 802 by the user 801 will now be described with reference to FIGS. 8A and 8B. The description is also applicable to the other embodiments of exercise systems described herein, with appropriate modifications (e.g., adjusting a single user support in systems that include a single horizontal handhold supported by a single user support).

To use the exercise system 802, the user 801 may first adjust the position of the sub-frame 804 relative to the treadmill 803. The user 801 may select the position of the sub-frame 804 to provide the desired support, ranging from overhead support (illustrated in FIG. 8A) to "pulling" support (illustrated in FIG. 8B), or to intermediate support positions (e.g., in between and combining overhead and "pulling" support). "Pulling" support refers to a configuration where the user 801 pulls on the handholds 806 in a rearward direction for support. Overhead support may include positioning the sub-frame 804 such that an anchor point 809 (the point or points where the user supports 805 are anchored to the sub-frame 804) is at a height that is generally greater than the height of a typical user. Overhead support may, for example, include positioning the sub-frame 804 at an angle between 70 and 110 degrees.

Once the sub-frame 804 is in the desired position, the user 801 may then adjust the length of the user supports 805 as desired. Where the sub-frame 804 is in a generally overhead position, adjusting the length of the user supports 805 effectively adjusts the heights of the handholds 806. Where the sub-frame 804 is in a "pulling" support position, adjusting the length of the user supports 805 effectively adjusts the fore-aft position of the user 801 along a movable endless belt 807 of the treadmill 803.

The user 801 may select from a wide variety of support configurations by adjusting the sub-frame 804 angle and user support 805 lengths.

For example, with the sub-frame 804 in a generally overhead position, the user 801 may adjust the handholds 806 such that the user 801 may use the handholds 806 for support while the user's 801 hands are positioned similar to where they typically are when walking (as shown in FIG. 8A), or the user 801 may choose to raise the handholds 806 such that the user's 801 forearms are parallel to the ground while grasping the handholds 806. Positions higher, lower, or in between those described may also be chosen by the user 801. In embodiments including two user supports, the lengths of the two user supports may be adjusted so that they are different from each other. Accordingly, the distance of the handholds 806 above the movable endless belt 807 (when allowed to hang freely) may, for example, be adjustable between 18 and 60 inches.

In another example, with the sub-frame 804 in a "pulling" support position, the user 801 may adjust the user supports 805 such that the user's 801 arms are forwardly extended (as shown in FIG. 8B) when using the handholds 806, or the user 801 may choose to lengthen the user supports 805 such that the user 801 is able to position the handholds 806 in a lower position (e.g., at the user's 801 waist). The length of the user supports 805 may also be adjusted to adjust the fore-aft positioning of the user 801 along the movable endless belt 807 of the treadmill 803.

While exercising on the exercise system 802, the user 801 may use the handholds 806 to provide a degree of support that allows supported hand and arm movement. This is in contrast to using a fixed support (e.g., grasping the frame of the treadmill 803) that provides for no hand movement, and to hands-free exercise, which provides no support. The adjustable and supported hand and arm movement achievable with the exercise system 802 may yield enhanced comfort, improved exercise enjoyment, increased exercise variety, a greater freedom of movement, and improved posture. Such supported hand and arm movement may accommodate natural hand and arm motion associated with walking, jogging or running.

The adjustment to the angle of the sub-frame 804 (and the other sub-frames discussed herein) may be motorized and/or automated. In this regard, a sub-frame motor (not shown) may be operable to adjust the angle of the sub-frame 804. The user 801 may adjust the angle of the sub-frame 804 by activating the sub-frame motor through a control device (e.g., a switch or button on a console 808). Alternatively or additionally, the position of the sub-frame 804 may be preprogrammed and/or programmed into a memory (e.g., within the console 808) and may be accessed by the exercise system 802 while the user 801 is exercising to vary the angle of the sub-frame 804 during exercise. Such varying may be performed in conjunction with varying other parameters of the exercise system, such as movable endless belt 807 speed or angle (relative to the floor beneath the exercise system 802).

In a variation, the sub-frame 804 of the exercise system 802 may be fixed relative to the treadmill 803 in the position illustrated in FIG. 8A. In this regard, in this variation, the position of the sub-frame 804 may be non-adjustable. In such an exercise system 802, the location of the anchor point 809 may be fixed relative to the treadmill 803. For example, as illustrated in FIG. 8A, the location of the anchor point may be disposed at a height that is generally above the height of a typical user (e.g., user 801) of the exercise system 802.

Similarly, in another variation, the sub-frame 804 may be fixed relative to the treadmill 803 in the position illustrated in FIG. 8B. In the present variation, the location of the anchor point 809 may be fixed relative to the treadmill 803 such that the anchor point 809 is disposed on an opposite side of the console 808 from a majority of the movable endless belt 807 and at a height that is generally in front of a typical user (e.g., user 801).

In other variations, the location of the anchor point 809 may be fixed relative to the treadmill 803 in other positions (e.g., between those illustrated in FIGS. 8A and 8B).

A method of exercising illustrated in FIGS. 8A and 8B may include exercising, by the user 801, on the moving endless belt 807 and grasping the handholds 806 (or any other handhold configuration illustrated herein) for support while exercising. In such a method, the user supports 805 may be flaccid and substantially inelastic. As illustrated in FIG. 8B, an entirety of the sub-frame 804 may be below the height of the user 801 on the movable endless belt 807. The method may include adjusting the orientation of the sub-frame 804 relative to the treadmill 803 (e.g., from the position illustrated in FIG. 8B to the overhead position illustrated in FIG. 8A).

Figure 8C:
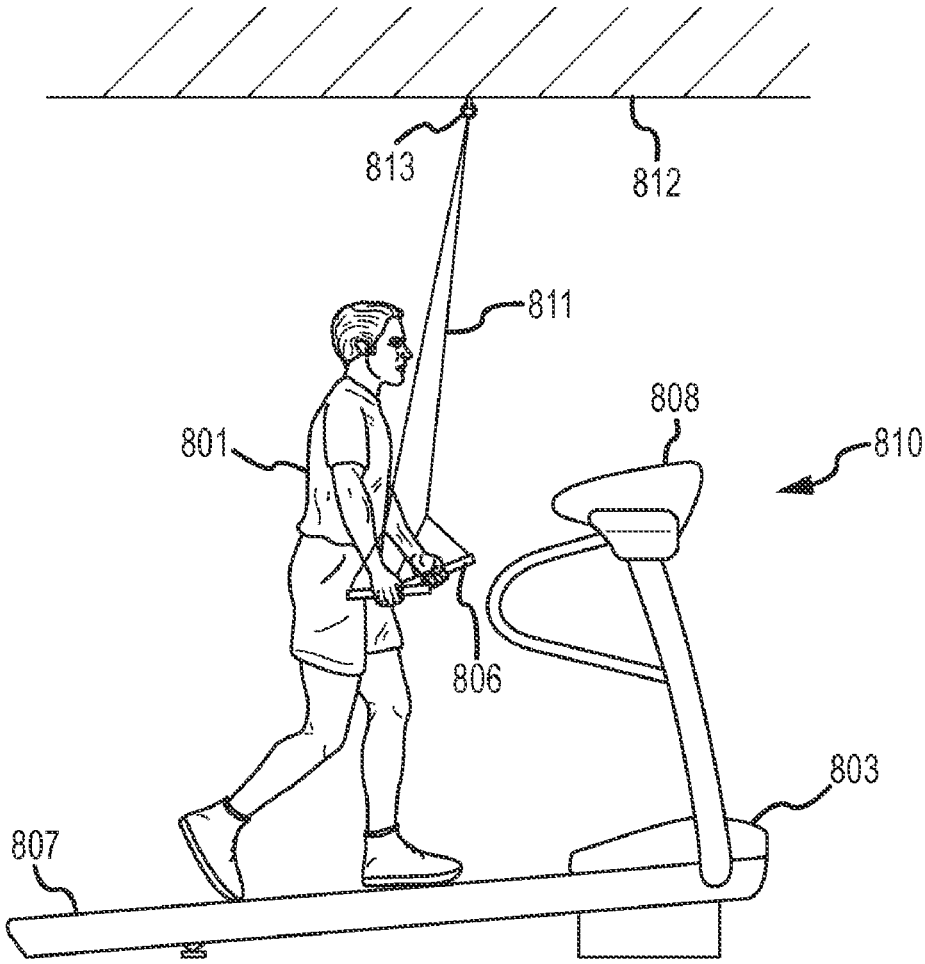
FIG. 8C illustrates a user exercising on another embodiment of an exercise system.

FIG. 8C illustrates the user 801 exercising on an exercise system 810 that includes the treadmill 803. In the exercise system 810, the handholds 806 are supported by user supports 811 that are interconnected to an overhead support such as a ceiling 812 at an interconnection site 813. The user supports 811 may include any of the features (e.g., springs, pulleys, adjustment mechanisms) discussed above with respect to the embodiments of FIGS. 1 through 8B. The interconnection site 813 may be a single point (e.g., a single eyelet) or it may include two separate points (e.g., two eyelets spaced apart as in FIG. 4). The position of the interconnection site 813 may be adjusted relative to the treadmill 803 by moving the treadmill 803 (e.g., forward or rearward relative to the interconnection site 813).

In alternate embodiments, the interconnection site 813 may be supported by and/or attached to other structures. For example, an overhead beam may be used in place of the ceiling 812. In another example, a free standing frame (e.g., not fixed to the treadmill 803) may be configured to position the interconnection site 813 relative to the treadmill 803. Such a freestanding frame may be portable such that it may be moved with the treadmill 803 or moved to provide support to a user of another exercise system. In another example, the interconnection site 813 may be supported by a wall or other structure located in front of the treadmill 803, thus providing a "pulling" support similar to that of FIG. 8B.

While various embodiments have been described in detail, it is apparent that further modifications and adaptations of the invention will occur to those skilled in the art. However, it is to be expressly understood that such modifications and adaptations are within the spirit and scope of the present invention.

What is claimed is:

1. An exercise system comprising:

a. an exercise treadmill comprising:

a frame having a front end and a rear end;

a longitudinal axis; and a movable endless belt disposed along said longitudinal axis;

b. a rigid sub-frame connected to said frame, wherein said sub-frame includes a first user support anchor point, wherein said rigid sub-frame comprises an inverted U shaped portion, wherein left and right end portions of the inverted U shaped portion are attached to left and right hand rails on said exercise treadmill, respectively, wherein a portion of each of the left and right end portions is substantially parallel to the left and right hand rails where the left and right end portions are attached to the left and right hand rails;

c. a first handhold;

d. a first user support, wherein said first handhold is supportably interconnected to said first user support, wherein said first user support is anchored to said sub-frame at said first user support anchor point, wherein a length of said first user support between said first handhold and said first user support anchor point is adjustably fixed, wherein said first user support between said first handhold and said first user support anchor point is flaccid; and e. a second user support, wherein said first handhold is supportably interconnected to said second user support, wherein said second user support is anchored to said sub-frame at a second user support anchor point, wherein a length of said second user support between said first handhold and said second user support anchor point is adjustably fixed, wherein said second user support between said first handhold and said second user support anchor point is flaccid, and wherein said first and second user support anchor points are disposed along a common portion of said sub-frame, wherein said first handhold comprises an elongated bar with first and second ends, wherein said first user support is interconnected to said elongated bar at said first end, and wherein said second user support is interconnected to said elongated bar at said second end, wherein an entirety of said length of said first user support between said first handhold and said first user support anchor point is substantially inelastic, wherein an entirety of said length of said second user support between said first handhold and said second user support anchor point is substantially inelastic.

* * * * *